United States Patent [19]

Virsen

[11] 4,214,392

[45] Jul. 29, 1980

[54] DISPLAY STRUCTURE

[76] Inventor: Gary R. Virsen, Rte. #2, Box 42, Rogers, Minn. 55374

[21] Appl. No.: 936,723

[22] Filed: Aug. 25, 1978

[51] Int. Cl.[2] ..... G09F 07/20

[52] U.S. Cl. ..... 40/605; 40/155; 40/606; 160/135; 248/163

[58] Field of Search ..... 40/605, 607, 606, 610, 40/611, 617, 152.1, 155, 624; 248/159, 163, 423, 432; 160/135, 351; 211/189, 199

[56] References Cited

U.S. PATENT DOCUMENTS

| | | | |
|---|---|---|---|
| 2,206,774 | 7/1940 | Hallowell | 248/163 |
| 3,174,629 | 3/1965 | Gelberg et al. | 40/610 X |
| 3,935,653 | 2/1976 | Klein | 40/606 |
| 3,938,772 | 2/1976 | Andrusiak | 40/155 |
| 4,108,316 | 8/1978 | Slater | 40/610 X |

FOREIGN PATENT DOCUMENTS

| | | | |
|---|---|---|---|
| 2222924 | 10/1974 | France | 40/610 |
| 582927 | 12/1976 | Switzerland | 40/606 |
| 1320229 | 6/1973 | United Kingdom | 40/606 |

*Primary Examiner*—John F. Pitrelli
*Attorney, Agent, or Firm*—Merchant, Gould, Smith, Edell, Welter & Schmidt

[57] ABSTRACT

A plurality of generally rectangular frames hinged together and having dislay panels mounted in display areas defined by the frames. Each frame includes a horizontal top frame member having downturned end portions and U-shaped frame members having horizontal bottom frame portions and laterally spaced apart vertical tubular side frame portions having longitudinal slots. Connector pins at the end portions of the top frame members are received in open upper ends of the tubular side frame portions. Display panels in the display areas are formed with outwardly projecting mounting tabs that are received in the slots of the side frame portions to hold the panels in place. Supporting legs have yokes at their upper ends that slidably engage the bottom frame portions of given ones of the frames, and clamping elements releasably lock the bottom frame portions against sliding movements in the yokes.

4 Claims, 5 Drawing Figures

FIG. 2
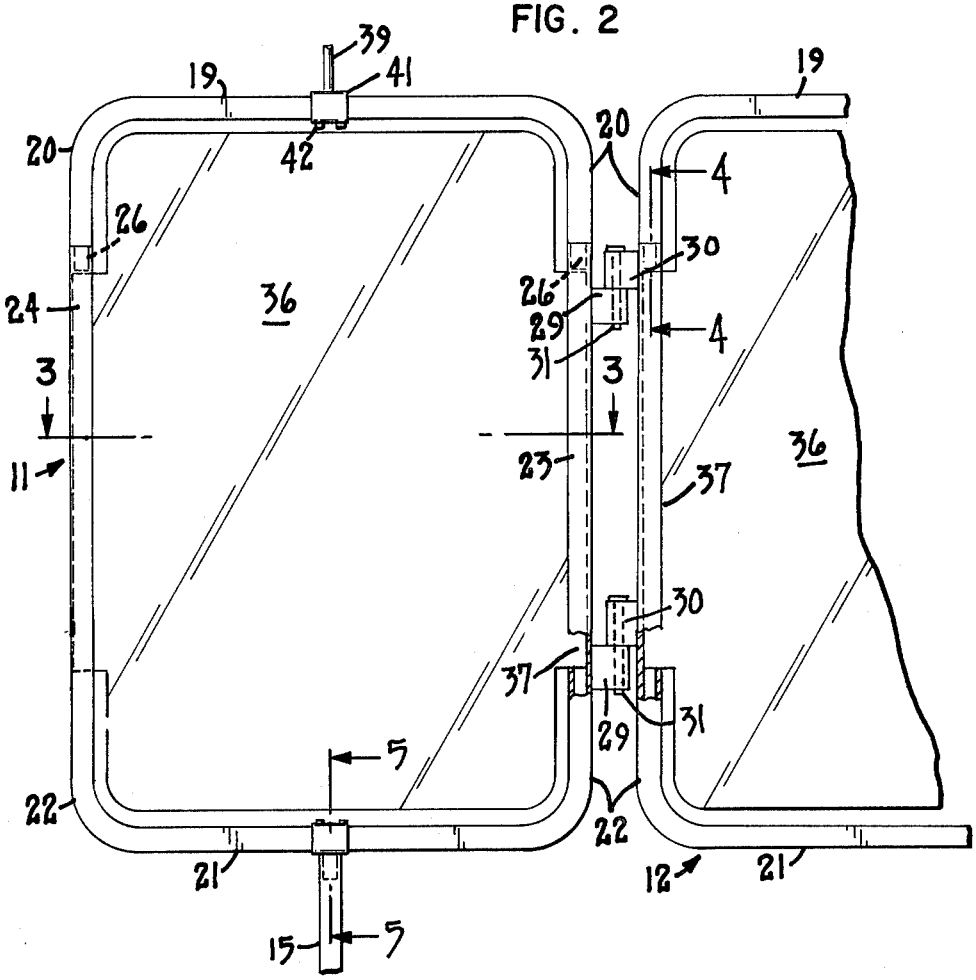
FIG. 3
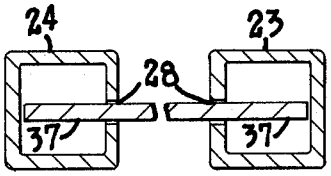
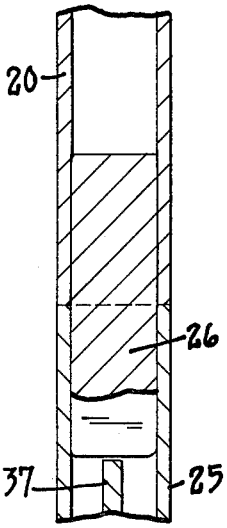
FIG. 4
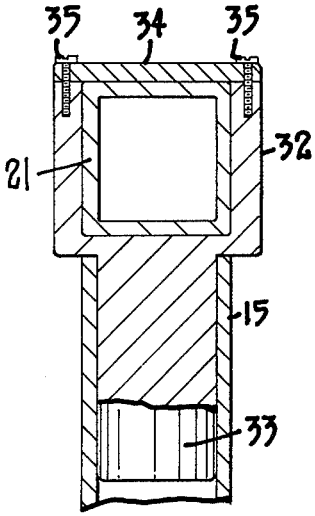
FIG. 5

DISPLAY STRUCTURE

BACKGROUND OF THE INVENTION

This invention relates generally to display structures, and more particularly to such structures that include panels for educational or advertising purposes. This invention involves such a structure that is free standing, that may be folded to occupy a minimum of space for storage, that may be quickly and easily assembled and disassembled for shipment in a compact package, and in which displays may be quickly and easily changed when desired.

SUMMARY OF THE INVENTION

The display structure of this invention comprises frame means including at least a pair of generally rectangular frames each defining a display area and each including a horizontal top frame member having downturned opposite end portions and a U-shaped frame member having a horizontal bottom portion and a pair of laterally spaced generally vertical tubular side frame portions having open upper ends. The end portions of the top frame member include connector pins received in respective open upper ends of the side frame portions, the side frame portions having opposed longitudinal slots to the interior thereof. Display panels, each disposed in a different display area, each have outwardly projecting mounting tabs at the opposite side edges thereof, the tabs being received in the slots of respective side frame portions, the mounting tabs having lower ends engaging the lower ends of said slots to be supported thereby. Hinge means connect said frames for pivotal movement relative to each other on a vertical axis, the display structure further including leg means for supporting said frames.

BRIEF DESCRIPTION OF THE DRAWING

FIG. 2 is a fragmentary view in front elevation of a portion of the structure of FIG. 1;

FIG. 3 is an enlarged horizontal section taken on the line 3—3 of FIG. 2;

FIG. 4 is an enlarged fragmentary section taken on the line 4—4 of FIG. 2; and FIG. 5 is a further enlarged fragmentary section taken on the line 5—5 of FIG. 2.

DETAILED DESCRIPTION OF THE PREFERRED EMBODIMENT

Figure 1:
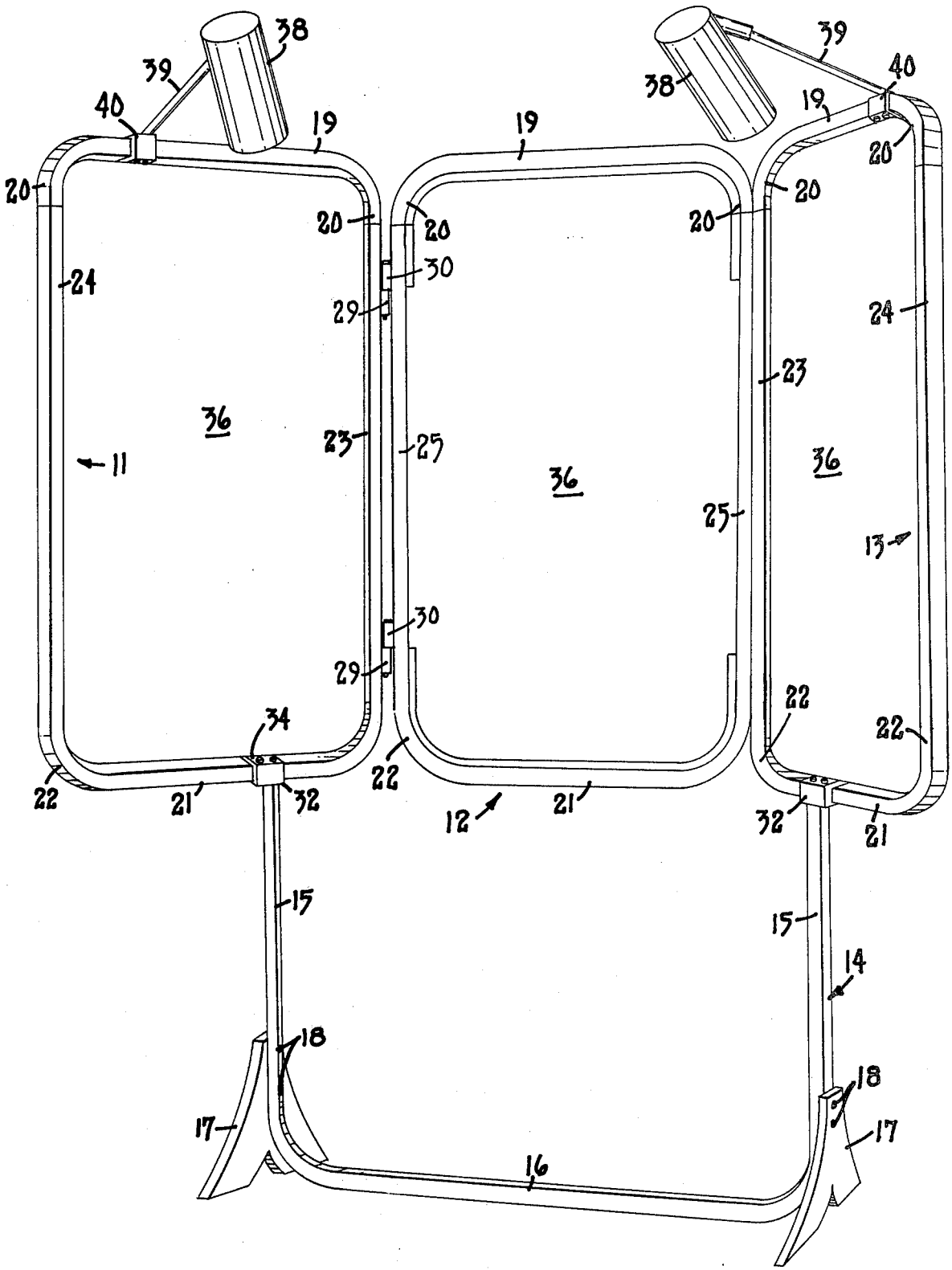
FIG. 1 is a view in perspective of a display structure produced in accordance with this invention.

In FIG. 1, a display structure produced in accordance with this invention is shown as comprising a plurality of generally rectangular frames 11, 12 and 13, that are supported in vertical positions by a generally U-shaped support member 14 which includes a pair of vertical leg portions 15 that extend upwardly from a bottom cross bar portion 16. A pair of foot elements 17 are secured to the leg portions 15 adjacent their lower ends, by screws or like fasteners 18. For the purpose of the present example, the frames 11, 12 and 13, as well as the support member 14 are shown as being fabricated from cross sectionally rectangular tubing, preferably of metal.

The frame 12 is shown in FIG. 1 as being a central frame, the frames 11 and 13 being disposed at opposite sides of the frame 12. Each of the frames 11, 12 and 13 comprise horizontally disposed top frame members 19 having downturned opposite end portions 20, and U-shaped frame members having horizontally disposed bottom frame portions 21 bent as indicated at 22 to provide laterally spaced apart vertical side frame portions. The side frame portions of each frame 11 and 13 are indicated at 23 and 24, the side frame portions of the frame 12 are indicated at 25. The laterally spaced vertical frame portions 25 are similar to the inner frame portion 23. The downturned end portions 20 of the top frame members 29 have welded or otherwise rigidly secured therein connector pins 26 that are slidably received in the upper ends of respective ones of the vertical frame portions 23, 24 and 25.

For the most part, the vertical frame portions 23, 24 and 25 are identical, one of the walls of each thereof having slots 28 therein that extend longitudinally for a substantial portion of the length of their respective frame portions 23, 24 and 25. As shown in FIG. 3, the slots 28 of the frame portions 23 and 24 are opposed, for a purpose which will hereinafter become apparent. The same arrangement exists between the slots of the frame portions 23 and 24 of the frame 13, and it may be assumed that the frame portions 25 of the frame 12 have opposed slots identical to the slots 28.

The frames 11 and 13 are pivotally connected to opposite sides of the frame 12 by hinges including hinge elements 29 on the frame portions 23, cooperating hinge elements 30 on the frame portions 25, and hinge pintles 31. The hinges permit the frames 11, 12 and 13 to be disposed at various angles relative to each other.

A pair of generally U-shaped yoke elements 32 are provided with mounting stems or pins 33 that extend downwardly into the upper end portions of the legs 15, the yokes 32 slidably engaging given ones of the bottom frame portions 21, see particularly FIG. 5. Each of the yoke elements 32 is provided with a plate-like clamping member 34 that overlies its respective bottom frame portion 21, and which is releasably secured to its respective yoke element 32 by clamping screws 35. When disposing the several frames 11, 12 and 13 at desired angular displacement with respect to each other, the clamping members 34 are loosened to permit sliding movements of the bottom frame portions 21 with respect to the yokes 32. When the desired positions of the several frames are established, the clamping screws 35 are tightened, so as to hold the frames in their desired angular relationships. With reference to FIG. 5, it will be noted that the stems 33 are cylindrical in shape, so as to permit the yokes 32 to rotate with respect to the legs 15.

Each of the frames 11, 12 and 13 supports a different one of a plurality of generally rectangular display panels 36 that are adapted to have imprinted or otherwise mounted thereon pictorial or printed matter, or any means of conveying a message, not shown. The panels 36 are formed to provide outwardly projecting tabs 37 at the opposite side edges thereof, the tabs 37 being elongated in a vertical direction. The tabs 37 are adapted to project through the slots 28 in the vertical frame portions 23, 24 and 25, and have their lower ends resting on the bottom ends of the slots 28, see particularly FIG. 2. The panels 36 are preferably rigid, the tabs 37 thereof being preferably of a thickness only slightly less than the width of the slots 28 in the vertical frame portions. When it is desired to mount a given panel 36 in its respective frame 11, 12 or 13, it is only necessary to remove a given top frame member 19 from engagement with its respective vertical frame portions 23, 24 or 25, after which the panel 36 may be disposed above the upper ends of the vertical frame portions, the tabs 37 aligned with their respective slots 28, and the panel 36 moved downwardly until the lower ends of the tabs 37 engage the lower ends of the slots 28. With the panel 36 thus in place, the top frame member is replaced on the upper ends of its respective vertical side frame portions 23, 24 or 25.

In FIG. 1, a pair of commercially available lamp fixtures 38 are shown as being provided with mounting arms 39 the lower ends of which are connected to yokes 40 similar to the yokes 32, slidably mounted on the top frame members 19. Like the yoke elements 32, the yoke elements 40 are provided with clamping plates 41 and clamping screws 42.

With the above-described arrangement, display panels 36 may be quickly and easily removed from their respective mounting frames and replaced by similar panels, and the entire structure may be quickly and easily assembled for use or disassembled for storage or shipment. By removing the pintles 31 from their respective hinge elements 29 and 30, and by disconnecting the foot elements 17 from the support member 14, the display structure may be boxed or crated so as to occupy a minimum of space. Assembly or disassembly of the structure can be achieved in a few minute's time.

Further, although three panel supporting frames are shown as being mounted on the support member 14, it will be appreciated that only a pair thereof may be hinged together and mounted on the support member 14, if desired.

While a commercial embodiment of display structure is shown and described, it will be understood that the same is capable of modification without departure from the spirit and scope of the invention, as defined in the claims.

I claim:

1. A display structure comprising:

(a) frame means including at least a pair of generally rectangular frames each defining a display area and each including a horizontal top frame member having downturned opposite end portions and a U-shaped frame member having a horizontal bottom portion and a pair of laterally spaced generally vertical tubular side frame portions having open upper ends;

(b) said end portions of the top frame member including connector pins received in respective open upper ends of said side frame portions;

(c) said side frame portions having opposed longitudinal slots to the interior thereof;

(d) display panels each disposed in a different display area and each having outwardly projecting mounting tabs at the opposite side edges thereof received in the slots of respective side frame members, said mounting tabs having lower ends engaging the lower ends of said slots to be supported thereby;

(e) hinge means connecting said frames for pivotal movement relative to each other on a vertical axis;

(f) and leg means for supporting said frames comprising a generally U-shaped member having a bottom cross bar portion and laterally spaced leg portions extending upwardly from said cross bar portion, further including a yoke element at the upper end of one of said leg portions and slidably receiving one of said bottom frame portions, and a clamping member on said yoke element for releasably locking said one of the bottom frame portions against sliding movements in said yoke element.

2. The display structure defined in claim 1 in which said frame members comprise lengths of cross-sectionally rectangular tubes.

3. The display structure defined in claim 1 in which said frames are disposed in side-by-side relationship, said hinge means comprising cooperating hinge elements on adjacent ones of said frame portions and hinge pintles for said cooperating hinge elements.

4. A display structure comprising:

(a) a rectangular central frame and a pair of rectangular side frames one at each side of said central frame, said frames each defining a different display area;

(b) said frames being of substantially equal size and including, horizontal top frame members having downturned opposite end portions and U-shaped frame members having horizontal bottom frame portions and laterally spaced vertical side frame portions having longitudinal slots therein and open upper ends;

(c) said end portions of the top frame member including connector pins received in respective ones of said open ends of respective side frame portions;

(d) hinge means connecting each of the opposite side frame portions of said central frame to one of the side frame portions of a different one of said side frames;

(e) a plurality of generally rectangular display panels each disposed in a different one of said display areas and each having outwardly projecting mounting tabs at the opposite side edges thereof received in the slots of the side frame members of their respective frames;

(f) and leg means for supporting said frames comprising a pair of leg elements and a crossbar portion connecting said leg elements, further including yoke elements on the upper ends of said leg elements and each slidably engaging the bottom frame portion of a different one of said side frames, and means for locking said side frame bottom frame portions against sliding movements relative to their respective yoke elements.

* * * * *